United States Patent [19]

Flaum et al.

[11] 4,179,158

[45] Dec. 18, 1979

[54] MODULAR BEAN BAG SEATING DEVICES

[76] Inventors: Dennis M. Flaum, 1 E. Schiller, Chicago, Ill. 60610; H. Lawrence Fleishman, 6518 N. Kenton, Lincolnwood, Ill. 60645

[21] Appl. No.: 861,830

[22] Filed: Dec. 19, 1977

[51] Int. Cl.[2] ..... A47C 13/00; A47C 15/00

[52] U.S. Cl. ..... 297/118; 297/248; 297/456; 297/DIG. 1

[58] Field of Search ..... 297/DIG. 6, 414, 455, 297/118, 411, 440, 456, 232, 248, DIG. 1; 5/12 R, 352; 190/8

[56] References Cited

U.S. PATENT DOCUMENTS

| | | | |
|---|---|---|---|
| 2,291,806 | 8/1942 | Diehl | 190/8 |
| 3,308,482 | 3/1967 | Lovette | 5/352 |
| 3,642,323 | 2/1972 | Taylor | 297/DIG. 1 |
| 3,675,970 | 7/1972 | Bereday | 297/DIG. 1 |
| 3,742,526 | 7/1973 | Lillard | 5/12 R |
| 3,890,658 | 6/1975 | Petersilie | 5/12 R |
| 3,929,375 | 12/1975 | Gans | 297/DIG. 6 |
| 3,951,453 | 4/1976 | Zapf | 297/414 X |
| 3,973,800 | 8/1976 | Kogan | 297/248 X |
| 4,027,888 | 6/1977 | Wilcox | 296/456 X |

FOREIGN PATENT DOCUMENTS 1163476 9/1969 United Kingdom ..... 297/DIG. 1

OTHER PUBLICATIONS

*Interiors,* Jun. 1974, vol. No. 133, p. 133.

*Primary Examiner*—James T. McCall
*Attorney, Agent, or Firm*—Alter and Weiss

[57] ABSTRACT

A modular bean bag seating device includes a pedestal, and cushion which rests atop the pedestal. Each module is partially stuffed with a filling material allowing each module to substantially maintain its respective shape. The cushion is detachably secured to the pedestal by interconnectable strips which are positioned about the periphery of each module. One portion of the interconnectable strip is affixed to the pedestal while the second portion is affixed to the cushion. Each portion of the interconnectable strip can be a slide fastener ribbon having a series of interconnectable elements; the two modules are then secured to one another by the use of a slider. The pedestal and cushion modules are interchangable as long as the interconnectable strips are similarly oriented.

4 Claims, 7 Drawing Figures

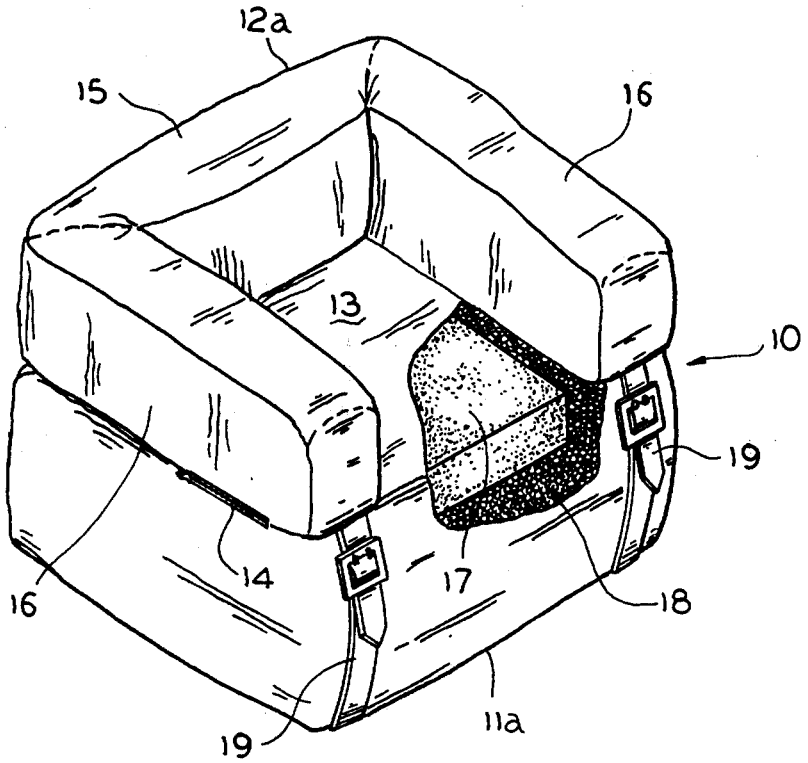

MODULAR BEAN BAG SEATING DEVICES

BACKGROUND OF THE INVENTION

The present invention relates in general to furniture and in particular to modular bean bag seating devices.

Most of the bean bag chairs in the prior art are one piece devices. These are soft and flexible, and usually do not maintain any single shape. Those that have two or more pieces are also either very flexibly, freely connected and do not maintain a fixed shape or the pieces are not restrainably connected to prevent relative movement. An example of the prior art, a furniture assembly by Dalsgard, U.S. Pat. No. 3,807,801, has three members—a U-shaped back and arm rest cushion, a seat cushion, and a neck pillow—that form a chair. The connection of the various members is accomplished by pairs of straps. Using this method of connecting the various members together, the neck pillow is not restrained in one position but rather can be rotated around the surface of the U-shaped back and arm rest cushion. The U-shaped back and arm rest cushion, connected to the seat cushion by pairs of straps, can also be rotated. The straps do not attach the members together in a manner restraining movement of the cushion to approximate a more conventional fixed-frame article of furniture.

The seat cushion of a bean bag chair may contain material beside some type of beans or pellets. For example, the Dalsgard patent shows the seat cushion containing a pad of foam rubber or plastic around which a granular material is stuffed. In addition, a patent for an inflatable chair by Savage, U.S. Pat. No. 3,408,107, has a pad of sponge rubber-like material for a seat and does not contain any granular material such as beans or pellets.

Toso, U.S. Pat. No. 3,955,850, features modular furniture elements, where each furniture element has a frame structure; the modules are connected alongside one another by a metal spring. The elements are restrainably connected by the rigid frame structure of the elements.

Ease of manufacture is another important characteristic of a bean bag chair. A patent for furniture construction by Marks, U.S. Pat. No. 3,965,506, allows the cover to be made of a generally rectangular piece of flexible material folded back over itself and stitched together in a particular manner. Although this bean bag chair is easily constructed, it is a one piece chair or multiple piece couch which is extremely flexible and does not maintain a fixed shape. The various parts of the couch are not restrainably connected.

Accordingly the present invention has the following objects:

To provide seating devices having multiple connectable units;

To provide seating devices having interchangeable units;

To provide seating devices which have an easy mechanism for attachement;

To provide seating devices which have an esthetical appearance;

To provide seating devices having no frame structure;

To provide seating devices which maintain a fixed shape; and

To provide seating devices into which a filling material may be inserted.

These and further objects will become more apparent upon consideration of the accompanying drawings, in which.

Figure 1:
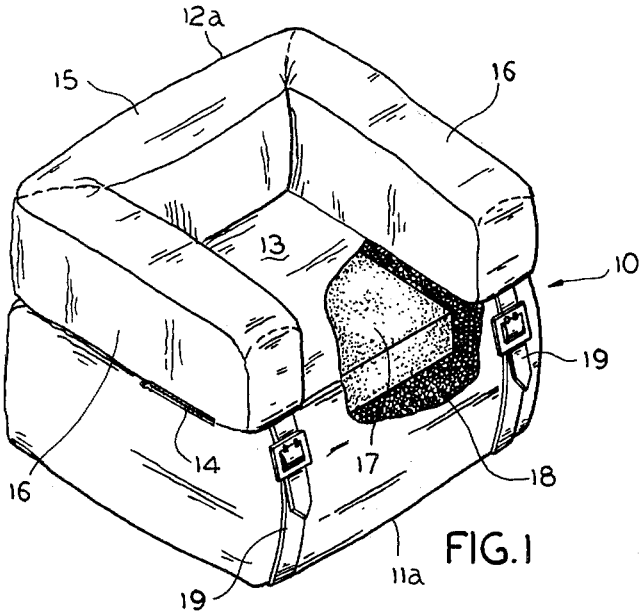
FIG. 1 is a perspective view of a preferred embodiment of a modular furniture device with a cutaway view of a portion of the interior of the pedestal.

Consistent with the foregoing objectives, Applicant provides a modular furniture device 10 having a cushion 12*a* resting atop a pedestal 11*a*. Cushion 12*a* is comprised of a back portion 15 and two arm rests 16. The pedestal and cushion modules are secured by three slide fasteners 14 which are located about the periphery of the modules. Each slide fastener has one series of interconnectable elements position about the periphery of cushion 12*a* and another series of interconnectable elements positioned about the periphery of pedestal 11*a*. The two series of interconnectable elements are then connected by slider 23 which secures cushion 12*a* to pedestal 11*a*. Pedestal 11*a* also contains a foam pad 17 which is subjacent to surface 13.

Referring now to FIG. 1, numeral 10 denotes a modular furniture construction having a hollow, stuffed pedestal 11*a* and a hollow, stuffed cushion 12*a*. Cushion 12*a* is shown atop horizontal upper surface 13 of pedestal 11*a*. A slide fastener 14 is shown securing cushion 12*a* to pedestal 11*a*. Cushion 12*a* is shown in this preferred embodiment as having a back 15 and two arms 16.

In the cutaway portion shown in FIG. 1 can be seen a foam pad 17 which is attached subjacent to surface 13 so that when a weight is placed upon cushion 11*a*, the weight is supported by foam pad 17 as well as filling material 18. Filling material 18 occupies the volume of pedestal 11*a* around foam pad 17. Both pedestal 11*a* and cushion 12*a* may be partially stuffed with filling material 18 in order that they may substantially retain their shape when a weight is placed thereupon. Also shown in FIG. 1 is belt 19 which is used to secure the frontmost portion of arm 16 so that cushion 12*a* cannot be substanially raised from its position atop pedestal 11*a*.

Figure 2:
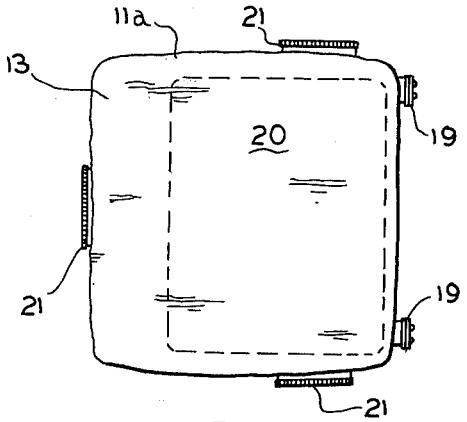
FIG. 2 is a top view of the pedestal.

FIG. 2, a top view of pedestal 11*a*, shows three slide fastener ribbons 21, which are parts of slide fasteners 14, attached to pedestal 11*a*. In addition, surface 13 is shown containing an outline marked by numeral 20 which is the stitching about foam pad 17. Here, foam pad 17 occupies a substantial portion of the area of surface 13. FIG. 2 also shows a portion of belt 19 attached to the front of pedestal 11*a*.

Figure 3:
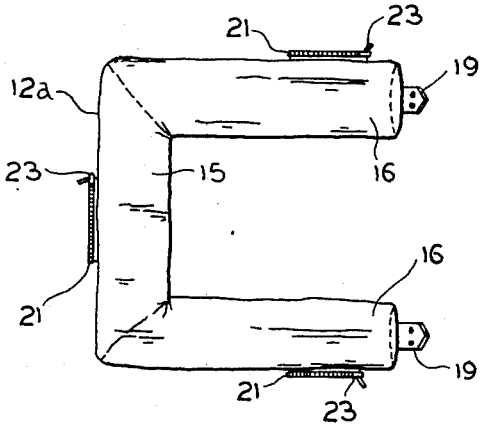
FIG. 3 is a top view of the cushion.

FIG. 3 shows cushion 12*a* of the preferred embodiment with back 15 and two arms 16. Cushion 12*a* has attached to it three ribbons 21, which are parts of slide fasteners 14. In this embodiment, ribbons 21, attached to cushion 12*a*, also have sliders 23 mounted thereto to interconnect or deinterconnect interconnectable elements 22. Having three securing positions allows the cushion to be restrainably secured to the pedestal and restricts the movability of cushion 12*a* with respect to pedestal 11*a*.

Figure 4:
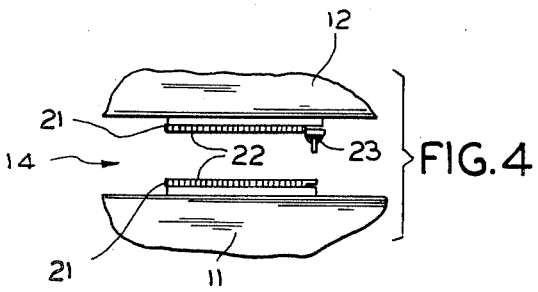
FIG. 4 is a front view of a slide fastener used to secure the cushion to the pedestal.

In FIG. 4 is shown slide fastener 14 which is used to secure cushion 12*a* to pedestal 11*a*. Slide fastener 14 consists of two ribbons 21 each containing a series of interconnectable elements 22. Interconnectable elements 22 are interconnected and deinterconnected by slider 23. Joining the two series of interconnectable elements 22 secures cushion 12*a* to pedestal 11*a*. The cushion and pedestal modules may thus be selectively interchanged.

Figure 5:
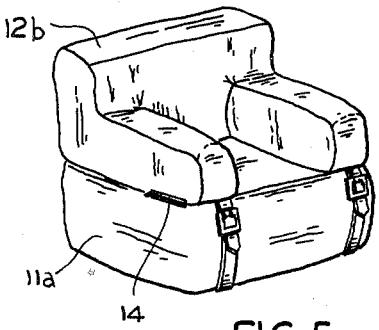
FIG. 5 is another embodiment of the module furniture device having a higher back.

As shown in FIG. 5, using pedestal 11*a*, it is possible for cushion module 12*a* to be interchanged with cushion module 12*b*. Of course, pedestal 11*a* can be used with a wide assortment of cushions in addition to cushions 12*a* and 12*b*, as long as the positioning of slide fasteners 14 are the same for the pedestal and the cushion. In the same manner, different pedestals may also be used with various cushions.

Figure 6:
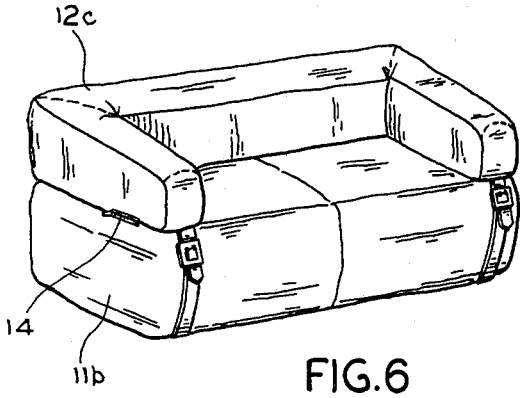
FIG. 6 is a perspective view of another embodiment of the modular furniture device having a longer pedestal and accompanyingly longer cushion.

FIG. 6 shows another embodiment of the modular furniture construction in which pedestal 11*b* and cushion 12*c* are longer than pedestal 11*a* and cushion 12*a* of the preferred embodiment. Again, it is possible for many types of pedestal and cushion combinations to be made so long as the placement of slide fasteners 14 are the same for the two modules. For instance, it is possible for pedestal 11*b* to be used with a cushion having only a back. In like manner, a number of individual pedestals may be interconnected to form a couch or love seat configuration, if desired using the same fasteners as illustrated in FIGS. 6 and 7.

Figure 7:
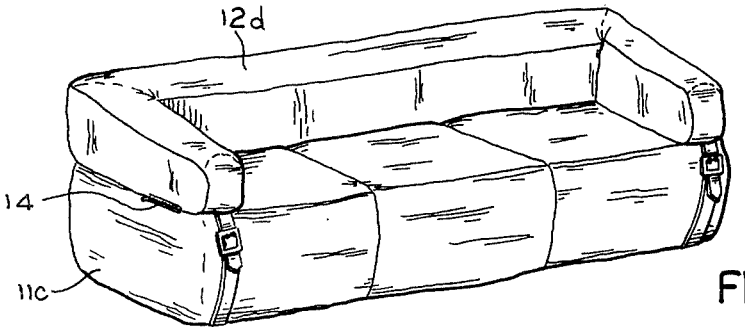
FIG. 7 is a fourth embodiment of the modular furniture device.

FIG. 7 shows an additional, larger, embodiment of the cushion, denoted here as 12*d* and of the pedestal, denoted by 11*c*. Of course, cushion 12*c* could not be interchanged with cushion 12*d* as they are of different lengths. But it would be possible to interchange cushion 12*d* with another cushion having a higher back or some other construction difference.

While the foregoing has presented several embodiments of the invention, it is to be understood that these embodiments are presented by way of example only. It is anticipated that other skilled in the art will perceive differences which, while differing from the foregoing, do not part from the spirit and scope of the invention as described and claimed.

What is claimed:

1. A modular furniture construction, comprising:

at least one pedestal formed from a plurality of panels including an upper, horizontal seating surface, a lower horizontal bottom, a front, a back and a plurality of sides;

at least one cushion, each said pedestal and each said cushion at least partially stuffed with a filling material allowing each said pedestal and each said cushion to substantially maintain their respective shapes when force is exerted thereon; and means for firmly and detachably securing selected of said cushions to selected of said pedestals with a bottom of each said cushion resting atop each said pedestal, and for firmly and detachably securing selected of said pedestals one to the other, said securing means including means positioned horizontally on each said pedestal about the periphery of each said pedestal where said seating surface meets said back and said sides, and characterized by being horizontally slidably engagable to enable lateral attachment of selected of said pedestals one to the other as well as enabling vertical attachment of selected of said cushions to selected of said pedestals.

2. The apparatus as recited in claim 1 in which said securing means comprises a plurality of interconnectable strips, each said strip having a first portion and a second portion, said first and second portions selectively interconnectable one with the other.

selected of said first and second portions integrally affixed about said back and said sides of each said pedestal where said seating surface and said sides meet and along the periphery of each said cushion, whereby at least one said first and second portion may be selectively horizontally interconnected when one cushion is positioned on one said pedestal, or when one said pedestal is situated adjacent to another said pedestal; and means to slidably interconnect said first portion and said second portion of each said strip.

3. The apparatus as recited in claim 1 wherein each said pedestal further includes a resilient pad having an upper surface and a lower surface, said pad being positioned within said pedestal immediately subjacent to said upper seating surface of said pedestal, said pad being supported over its entire area of coverage by said filling material and, said pad shaped and sized to contact and support substantially the entire of said seating surface.

4. The apparatus as recited in claim 1 wherein said securing means further includes at least one first strap member affixed to said cushion, at least one second strap member affixed to said pedestal, said first and second strap members being selectively attachable one to the other by means of a buckle, said first and second strap members being positioned to enable the selective fastening thereof when said cushion is positioned upon said pedestal.

* * * * *